US005527504A

United States Patent [19]

Kishimoto et al.

[11] Patent Number: 5,527,504

[45] Date of Patent: Jun. 18, 1996

[54] POWDER MIXTURE FOR USE IN COMPACTION TO PRODUCE RARE EARTH IRON SINTERED PERMANENT MAGNETS

[75] Inventors: Yoshihisa Kishimoto, Ikoma; Nobushige Hiraishi; Wataru Takahashi, both of Nishinomiya; Masakazu Ohkita, Ashiya; Naoyuki Ishigaki, Otsu; Yutaka Matsuura, Hyogo-ken, all of Japan

[73] Assignees: Sumitomo Metal Industries, Ltd.; Sumitomo Special Metals Co. Ltd., both of Osaka, Japan

[21] Appl. No.: 437,373

[22] Filed: May 9, 1995

Related U.S. Application Data

[62] Division of Ser. No. 364,315, Dec. 27, 1994, Pat. No. 5,486,224.

[30] Foreign Application Priority Data

Dec. 28, 1993 [JP] Japan ..... 5-335406
Oct. 19, 1994 [JP] Japan ..... 6-253904

[51] Int. Cl.[6] ..... B22F 3/12

[52] U.S. Cl. ..... 419/38; 419/10; 419/12; 419/39; 419/53

[58] Field of Search ..... 419/10, 12, 35, 419/39, 53; 75/230; 148/101, 103, 301, 306; 252/62, 54

[56] References Cited

U.S. PATENT DOCUMENTS

| | | | |
|---|---|---|---|
| Re. 34,838 | 1/1995 | Mohri et al. | 148/302 |
| 4,264,361 | 4/1981 | Yajima et al. | 75/230 |
| 4,597,738 | 7/1986 | Matsuura et al. | 419/23 |
| 4,770,273 | 9/1988 | Sagawa et al. | 148/302 |
| 5,380,179 | 1/1995 | Nishimura et al. | 419/36 |
| 5,393,445 | 2/1995 | Furuya et al. | 252/62.54 |
| 5,427,734 | 6/1995 | Yamashita et al. | 419/23 |

FOREIGN PATENT DOCUMENTS

| | | |
|---|---|---|
| 57-63601 | 4/1982 | Japan . |
| 59-46008 | 3/1984 | Japan . |
| 59-64733 | 4/1984 | Japan . |
| 63-138706 | 6/1988 | Japan . |
| 63-317643 | 12/1988 | Japan . |
| 4-52203 | 2/1992 | Japan . |
| 4-124202 | 4/1992 | Japan . |
| 4-191302 | 7/1992 | Japan . |
| 4-191392 | 7/1992 | Japan . |
| 4-214803 | 8/1992 | Japan . |
| 4-214804 | 8/1992 | Japan . |
| 5-295490 | 11/1993 | Japan . |

*Primary Examiner*—Charles T. Jordan
*Assistant Examiner*—John N. Greaves
*Attorney, Agent, or Firm*—Burns, Doane, Swecker & Mathis

[57] ABSTRACT

To a fine R-Fe-B alloy powder comprised predominantly of 10–30 atomic % of R (wherein R stands for at least one elements selected from rare earth elements including yttrium), 2–28 atomic % of B, and 65–82 atomic % of Fe in which up to 50 atomic % of Fe may be replaced by Co, at least one boric acid ester compound such as tributyl borate is added as a lubricant in a proportion of 0.01%–2% by weight and mixed uniformly before, during, or after fine grinding of the alloy powder. The resulting powder mixture is compacted by compression molding in a magnetic field and the green compacts are sintered and aged. Compression molding can be performed continuously without need of mold lubrication, and the resulting magnets have improved magnet properties with respect to residual flux density, maximum energy product, and intrinsic coercive force.

26 Claims, No Drawings

POWDER MIXTURE FOR USE IN COMPACTION TO PRODUCE RARE EARTH IRON SINTERED PERMANENT MAGNETS

This application is a divisional, of application Ser. No. 08/364,315, filed Dec. 27, 1994 (U.S. Pat. No. 5,486,224).

BACKGROUND OF THE INVENTION

The present invention relates to a process for producing rare earth iron-based sintered permanent magnets of high performance, which predominantly comprise one or more rare earth metals, boron, and iron (or iron and cobalt), and to a powder mixture for use in compaction to produce rare earth iron sintered permanent magnets by such a process.

Permanent magnets are one class of important materials commonly incorporated in electrical or electronic equipment and are widely used in various apparatuses ranging from household appliances to peripheral equipment for supercomputers. Due to a continuing demand for electrical and electronic equipment having a reduced size and improved performance, permanent magnets are also required to have improved performance.

The magnetic performance of a permanent magnet is normally evaluated by intrinsic coercive force (iHc), residual flux density (Br), and maximum magnetic energy product [(BH)max], all of which should be as high as possible. These magnetic properties are hereinafter referred to as "magnet properties".

Typical conventional permanent magnets are Alnico, hard ferrite, and rare earth cobalt magnets. Due to recent instability of the cobalt supply, the demand for Alnico magnets has been declining since they contain on the order of 20%–30% by weight of cobalt. Instead, inexpensive hard ferrite, which predominantly comprises iron oxide, has tended to be predominantly used as a material for permanent magnets.

Rare earth cobalt magnets are very expensive since they comprise about 50%–60% by weight of cobalt and contain samarium (Sm) which is present in a rare earth ore in a minor proportion. Nevertheless, such magnets have increasingly been used, mainly in compact magnetic circuits of high added value, in view of their magnet properties, which are significantly superior to those of other magnets.

Recently developed permanent magnets are rare earth iron magnets, which are less expensive than rare earth cobalt magnets since they need not contain expensive samarium or cobalt and yet exhibit good magnet properties. For example, a permanent magnet made of a magnetically anisotropic sintered body comprising a rare earth metal (REM), iron, and boron is disclosed in Japanese Patent Application Laid-Open (Kokai) No. 59-46008(1984). A similar magnetically anisotropic sintered permanent magnet in which iron is partially replaced by cobalt such that the resulting alloy has an increased Curie point so as to minimize the temperature dependence of magnet properties is disclosed in Japanese Patent Application Laid-Open (Kokai) No. 59-64733(1984).

These magnets, which comprise REM, Fe, and B, or REM, Fe, Co, and B, are hereinafter referred to as R-Fe-B magnets, in which R stands for at least one element selected from rare earth elements including yttrium (Y), and part of Fe may be replaced by Co. Magnetically anisotropic R-Fe-B permanent magnets exhibit, in a particular direction, excellent magnet properties which are superior even to those of the above-mentioned rare earth cobalt magnets.

R-Fe-B sintered permanent magnets are usually produced by melting constituent metals or alloys (e.g., ferroboron) together to form a molten alloy having a predetermined composition, which is then cast to form an ingot. The ingot is crushed to an average particle diameter of 20–500 μm and then finely ground to an average particle diameter of 1–20 μm to prepare an R-Fe-B alloy powder to be used in compaction.

Alternatively, an R-Fe-B alloy powder may be directly prepared by the reduction diffusion method in which a mixture of a rare earth metal oxide powder, iron powder, and ferroboron powder is reduced with granular calcium metal and the reaction mixture is treated with water to remove calcium oxide formed as a by-product. In this case, the resulting alloy powder may be finely ground to an average particle diameter of 1–20 μm, if necessary.

Since the R-Fe-B alloy has a main crystal structure of the tetragonal system, it can readily be finely divided to form a fine alloy powder having a relatively uniform size. The finely ground alloy powder is compacted by pressing (compression molding) while a magnetic field is applied in order to develop magnetic anisotropy, and the green powder compacts formed are sintered to give sintered permanent magnets, which may be subjected to aging after sintering. If desired, the sintered magnets may be plated with an anti-corrosive film of Ni or the like in order to provide the magnets with improved corrosion resistance.

It is described in Japanese Patent Applications Laid-Open Nos. 63-317643(1988) and 5-295490(1993) that a molten R-Fe-B alloy is rapidly solidified by the twin or single roll method to form a thin sheet or thin flakes having a thickness of 0.05–3 mm and consisting of fine grains in the range of 3–30 μm. The thin sheet or flakes are crushed and finely ground to be used in the production of sintered magnets. The resulting sintered magnet has further improved magnet properties, particularly in maximum energy product [(BH-)max].

In compression molding of an alloy powder to produce a magnetically anisotropic sintered magnet, a small proportion of a lubricant is normally added to the powder in order to ensure mobility of the alloy powder during compaction and facilitate mold release. If the mobility is not sufficient, friction between the powder and the mold such as the die wall exerted during compression may cause flaws, delaminations, or cracks to occur on the surface of the die or green compact, and rotation of the powder is inhibited. Such rotation is required to align the readily magnetizable axes of individual particles of the alloy powder along the direction of the applied magnetic field so as to develop magnetic anisotropy.

Various substances have been proposed as lubricants for use in compaction of an R-Fe-B alloy powder for use in the production of sintered magnets. Examples of such substances include higher fatty acids such as oleic acid and stearic acid and their salts and bisamides as described in Japanese Patent Applications Laid-Open Nos. 63-138706(1988) an 4-214803(1992), higher alcohols and polyethylene glycols as described in Japanese Patent Application Laid-Open No. 4-191302(1992), polyoxyethylene derivatives such as fatty acid esters of a polyoxyethylene sorbitan or sorbitol as described in Japanese Patent Application Laid-Open No. 4-124202(1992), a mixture of a paraffin and a sorbitan or glycerol fatty acid ester as described in Japanese Patent Application Laid-Open No. 4-52203(1992), and solid paraffin and camphor as described in Japanese Patent Application Laid-Open No. 4-214804(1992).

It is described in Japanese Patent Application Laid-Open No. 4-191392(1992) that a lubricant such as a higher fatty acid or polyethylene glycol is added to an R-Fe-B alloy powder during fine grinding so as to coat the alloy powder with the lubricant in a dry process.

However, the lubricating effects of conventional lubricants are not very high, so it is necessary to apply a mold release agent such as a fatty acid ester to the mold or add a lubricant to the alloy powder in a large proportion in order to prevent the occurrence of flaws or the like on the surface of the die or the green compacts. Application of a mold release agent makes the compacting procedure complicated, thereby significantly interfering with the production efficiency of continuous mass production of sintered magnets. Addition of a lubricant in a large proportion results in an increased residual carbon content of the magnets formed after sintering, thereby adversely affecting the magnet properties, particularly intrinsic coercive force (iHc) and maximum energy product [(BH)max]. In addition, due to the extremely high tendency for agglomeration, the lubricant is present as agglomerated masses even after being mixed with the alloy powder, and this leaves large voids which cause pinholes to form when the sintered magnets are finally coated with an anticorrosive film. If the lubricating effect is insufficient, the alloy powder is prevented from rotating during compaction in a magnetic field, thereby adversely affecting the alignment of the powder and hence the residual flux density (Br) of the resulting magnet.

SUMMARY OF THE INVENTION

It is an object of the present invention to provide a process for producing R-Fe-B sintered permanent magnets having satisfactory magnet properties with addition of a lubricant in a small proportion and without application of a mold release agent to the mold, thereby making continuous mass production of such magnets possible with high efficiency.

Another object of the present invention is to provide a powder mixture for use in compaction in the above-described process.

It has been found that a boric acid ester (borate ester) is highly suitable as a lubricant to be added to an R-Fe-B alloy powder when the powder is compacted in a mold, since the borate ester can be uniformly dispersed in the powder and addition of a borate in a small proportion has a great effect on decreasing the friction between the die surface and particles of the alloy powder and between particles of the alloy powder. Furthermore, a borate ester is readily vaporized during subsequent sintering. As a result, use of a borate ester as a lubricant makes it possible to perform compaction of the alloy powder continuously in mass production of sintered magnets without application of a mold release agent and to produce R-Fe-B sintered permanent magnets having excellent magnet properties in all of residual flux density (Br), intrinsic coercive force (iHc), and maximum energy product [(BH)max].

The present invention provides a powder mixture for use in compaction to produce rare earth iron sintered permanent magnets, the mixture consisting essentially of an R-Fe-B alloy powder and at least one boric acid ester compound substantially uniformly mixed with the alloy powder, the R-Fe-B alloy powder being comprised predominantly of 10–30 at% of R (wherein R stands for at least one elements selected from rare earth elements including yttrium and "at%" is an abbreviation for atomic percent), 2–28 at% of B, and 65–82 at% of Fe in which up to 50 at% of Fe may be replaced by Co.

The present invention also provides a process for producing R-Fe-B sintered permanent magnets having improved magnet properties, comprising compression molding the above-described powder mixture, preferably in a magnetic field, to form green compacts, sintering the green compacts, and optionally subjecting the sintered bodies to aging and coating with an anticorrosive film.

DETAILED DESCRIPTION OF THE INVENTION

The R-Fe-B alloy powder used in the present invention has a chemical composition comprised predominantly of 10–30 at% of R, 2–28 at% of B, and 65–82 at% of Fe, and it has a microstructure predominantly comprising $R_2Fe_{14}B$ grains.

The rare earth element R includes yttrium (Y) and encompasses both light rare earth elements (from La to Eu) and heavy rare earth elements (from Gd to Lu). Preferably R is comprised solely of one or more light rare earth elements, and Nd and Pr are particularly preferred as R. R may be constituted by a single rare earth element, or it may be a less expensive mixture of two or more rare earth elements such as mish metal or didymium. It is preferred that rare earth elements other than Nd and Pr, i.e., Sm, Y, La, Ce, Gd, etc., be used in admixture with Nd and/or Pr, if present.

R need not be pure and may be of a commercially available purity. Namely, the rare earth metal or metals used may be contaminated with impurities inevitably incorporated therein.

When the content of R is less than 10 at%, an α-Fe phase is precipitated in the alloy microstructure, thereby adversely affecting the grindability of the alloy and magnet properties, particularly the intrinsic coercive force (iHc) of the resulting magnets. A content of R greater than 30 at% results in a decrease in residual flux density (Br). A content of B less than 2 at% does not give a high intrinsic coercive force, while a content of B greater than 28 at% results in a decrease in residual flux density. An Fe content of less than 65 at% leads to a decrease in residual flux density, while an Fe content of greater than 82 at% does not give a high intrinsic coercive force.

Cobalt may be partially substituted for iron in order to increase the Curie point of the alloy and minimize the temperature dependence of magnet properties. However, if the proportion of Co is greater than that of Fe, the intrinsic coercive force is decreased. Therefore, the proportion of Co, when present, is limited to up to 50 at% of the total proportion of Fe and Co. Namely, the proportion of Co in the alloy is from 0 to 41 at%. When added, it is preferable that Co be present in a proportion of at least 5 at% in order to fully attain the effect of Co. A preferable proportion of Co is from 5 to 25 at%.

In order to assure that the resulting magnet has both high residual flux density and high intrinsic coercive force, it is preferred that the alloy composition comprise 10–25 at% of R, 4–26 at% of B, and 65–82 at% of Fe and more preferably 12–20 at% of R, 4–24 at% of B, and 65–82 at% of Fe.

The alloy composition may further contain, in addition to R, B, and Fe (or Fe+Co), and inevitable impurities, one or more other elements which are intentionally added in minor proportions for the purpose of decreasing the material costs or improving the properties of the magnets.

For example, part of B may be replaced by up to 4.0 at% in total of one or more elements selected from up to 4.0 at% of C, up to 4.0 at% of Si, up to 3.5 at% of P, up to 2.5 at% of S, and up to 3.5 at% of Cu, in order to facilitate preparation of the alloy powder or lower the material costs.

One or more elements selected from up to 9.5 at% of Al, up to 4.5 at% of Ti, up to 9.5 at% of V, up to 8.5 at% of Cr, up to 8.0 at% of Mn, up to 5 at% of Bi, up to 12.5 at% of Nb, up to 10.5 at% of Ta, up to 9.5 at% of Mo, up to 9.5 at% of W, up to 2.5 at% of Sb, up to 7 at% of Ge, up to 3.5 at% of Sn, up to 5.5 at% of Zr, up to 5.5 at% of Hf, up to 5.5 at% of Mg, and up to 5.5 at% of Ga may be added in order to further improve the intrinsic coercive force of the magnets.

The R-Fe-B alloy powder may be prepared by any method. In accordance with a conventional method, starting materials (constituent metals or alloys) are melted together in a vacuum or in an inert atmosphere using a high-frequency induction furnace or arc furnace, for example, to form a molten alloy having a predetermined composition, which is then cast into a water-cooled mold to form an alloy ingot.

The ingot is mechanically crushed to an average particle diameter of 20–500 μm using a stamp mill, jaw crusher, Brown mill, or similar crusher, and then finely ground to an average particle diameter of 1–20 μm using a jet mill, vibration mill, ball mill, or similar grinding mill to prepare an R-Fe-B alloy powder to be used in compaction.

Alternatively, crushing may be performed by the hydrogenation crushing method in which the R-Fe-B alloy is kept in a hydrogen gas to decompose it into a rare earth metal hydride, $Fe_2B$, and Fe and the partial pressure of hydrogen is then reduced to liberate hydrogen from the rare earth metal hydride and form an R-Fe-B alloy powder. The resulting alloy powder can be finely ground in the same manner as described above with good grindability.

The finely ground alloy powder has an average particle diameter in the range of 1–20 μm and preferably 2–10 μm (as determined by the air-permeability method). When the average particle diameter of the alloy powder is greater than 20 μm, satisfactory magnet properties, particularly a high intrinsic coercive force, cannot be obtained. When it is less than 1 μm, oxidization of the alloy powder during production of sintered magnets, i.e., during compacting, sintering, and aging steps, becomes appreciable, thereby adversely affecting the magnet properties.

Advantageously, the R-Fe-B alloy may be prepared by the rapid solidification method as described in Japanese Patent Applications Laid-Open Nos. 63-317643(1988) and 5-295490(1993), thereby making it possible to produce a sintered permanent magnet having further improved magnet properties.

In the rapid solidification method, a molten R-Fe-B alloy prepared in the same manner as described above is rapidly solidified by the single roll method (unidirectional cooling) or twin roll method (bidirectional cooling) to form a thin sheet or thin flakes having a thickness of 0.05–3 mm and a uniform microstructure having an average grain size of 3–30 μm. The single roll method is preferable in view of higher efficiency and uniformity of quality. If the thickness of the sheet or flakes is less than 0.05 mm, the solidification speed is so rapid that the average grain size of the solidified alloy may be decreased to less than 3 μm, thereby adversely affecting the magnet properties. On the contrary, a thickness greater than 3 mm makes the cooling rate so slow that an α-Fe phase forms and the grain size increases to over 30 μm, resulting in a deterioration in magnet properties. Preferably, the thickness is between 0.15 mm and 0.4 mm and the average grain size is between 4 μm and 15 μm.

The grain size means the width of a columnar $R_2Fe_{14}B$ grain formed in a rapidly cooled R-Fe-B alloy, wherein the width corresponds to the length measured perpendicularly to the longitudinal direction of the columnar grain. Specifically, a rapidly solidified alloy in the form of a thin sheet or flake is sliced and polished such that a section approximately parallel to the longitudinal direction of the columnar grains is exposed, and the width of each of about 100 columnar grains, which are selected at random, is measured on an electron micrograph of the section. The average of the values for width measured in this way is the average grain size.

The thin sheet or flakes formed by the rapid solidification method is then crushed and finely ground in the same manner as described above to prepare an alloy powder. The R-Fe-B alloy formed by the rapid solidification method has good grindability and can readily produce a fine powder having an average particle diameter of 3–4 μm with a narrow size distribution.

In accordance with the present invention, at least one boric acid ester is added as a lubricant to an R-Fe-B alloy powder as prepared above and mixed therewith substantially uniformly to form a powder mixture for use in compaction to produce sintered permanent magnets. The borate ester lubricant may be added before, during, or after fine grinding to obtain the alloy powder.

The borate ester is a boric acid tri-ester type compound obtained by an esterification reaction of boric acid (either orthoboric acid, $H_3BO_3$ or metaboric acid, $HBO_2$) or boric anhydride ($B_2O_3$) with one or more monohydric or polyhydric alcohols.

The monohydric or polyhydric alcohols which can be used to esterify boric acid or boric anhydride include the following (1) to (4):

(1) monohydric alcohols of the formula $R_1$—OH;

(2) diols of the formula:

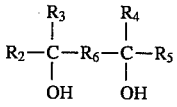

(3) glycerol and substituted glycerols and their monoesters and diesters; and (4) polyhydric alcohols other than (2) and (3) and their esters and alkylene oxide adducts.

In the above formulas, $R_1$ is an aliphatic, aromatic, or heterocyclic saturated or unsaturated organic radical having 3 to 22 carbon atoms;

$R_2$, $R_3$, $R_4$, and $R_5$, which may be the same or different, are each H or an aliphatic or aromatic saturated or unsaturated radical having 1 to 15 carbon atoms; and $R_6$ is a single bond, —O—, —S—, —$SO_2$—, —CO—, or an aliphatic or aromatic saturated or unsaturated divalent radical having 1 to 20 carbon atoms.

Examples of monohydric alcohols (1) include n-butanol, iso-butanol, n-pentanol, n-hexanol, n-heptanol, n-octanol, 2-ethylhexanol, nonanol, decanol, undecanol, dodecanol, tridecanol, tetradecanol, pentadecanol, hexadecanol, heptadecanol, octadecanol, and nonadecanol, and preferably those alcohols having 3 to 18 carbon atoms. In addition, aliphatic unsaturated alcohols such as allyl alcohol, crotyl alcohol, and propargyl alcohol; alicyclic alcohols such as cyclopentanol and cyclohexanol; aromatic alcohols such as benzyl alcohol and cinnamyl alcohol; and heterocyclic alcohols such as furfuryl alcohol may be used. Monohydric alcohols having one or two carbon atoms (ethanol and methanol), are not useful since a borate ester with such an alcohol has a boiling point which is so low that it is readily vaporized out after mixing with the alloy powder. A borate ester with a monohydric alcohol having more than 22 carbon atoms has a high melting point and is somewhat difficult to uniformly mix with the alloy powder. Furthermore, it may partially be left as residual carbon after sintering.

Examples of diols (2) include ethylene glycol, propylene glycol, 1,3-butanediol, 1,4-butanediol, 1,5-pentanediol, 2-methyl-2,4-pentanediol, neopentyl glycol, 1,6-hexanediol, 1,7-heptanediol, 1,8-octanediol, 1,9-nonanediol, 1,10-decanediol, and similar α,ω-glycols, as well as pinacol, hexane-1,2-diol, octane-1,2-diol, and butanoyl-α-glycol, and similar symmetric α-glycols. Those diols containing not greater than 10 carbon atoms and having a relatively low melting point are preferred since they can be readily synthesized with low costs.

Glycerols (3) include glycerol and its monoesters and diesters with one or more fatty acids having 8 to 18 carbon atoms. Typical examples of these esters are lauric acid mono- and di-glycerides and oleic acid mono- and di-glycerides. In addition, substituted glycerols such as butane-1,2,3-triol, 2-methylpropane-1,2,3-triol, pentane-2,3,4-triol, 2-methylbutane-1,2,3-triol, and hexane-2,3,4-triol, as well as their monoesters and diesters with one or more fatty acids having 8 to 18 carbon atoms may be used.

Examples of polyhydric alcohols (4) include trimethylolpropane, pentaerythritol, arabitol, sorbitol, sorbitan, mannitol, and mannitan. In addition, monoesters, diesters, triesters, etc. of these polyhydric alcohols with one or more fatty acids having 8 to 18 carbon atoms in which at least one hydroxyl group remains unesterified, as well as ether-type adducts of 1 to 20 moles and preferably 4 to 18 moles of an alkylene oxide such as ethylene oxide or propylene oxide to these polyhydric alcohols may be used.

The esterification of boric acid or boric anhydride with an alcohol or alcohols readily proceeds merely by heating these reactants together. The reaction temperature depends on the particular alcohol or alcohols used and is normally between 100° and 180° C. The reactants are preferably used in approximately stoichiometric proportions. The resulting borate ester is generally a liquid or solid at room temperature.

The method by which a borate ester lubricant is mixed with the alloy powder is not critical as long as a substantially uniform mixture is obtained. The mixing may be performed by either a dry process or a wet process. The temperature at which the lubricant is mixed depends on the melting point thereof and is generally from room temperature to 50° C.

When fine grinding of the alloy powder is performed by wet milling, the borate ester lubricant may be added to a slurry of the alloy powder before, during, or after wet milling of the powder, and mixed therewith in a wet process to obtain the powder mixture according to the present invention. The liquid medium used in such wet mixing is preferably an aromatic hydrocarbon such as toluene or an aliphatic hydrocarbon having 6 to 18 carbon atoms.

However, since fine grinding of the alloy powder is usually performed by a dry process and particularly by use of a jet mill, it is preferred that mixing of the alloy powder with the borate ester lubricant also be performed by a dry process. Specifically, dry mixing can be performed by the following methods, which are illustrative and not restrictive.

(1) Mixing before fine grinding:

The alloy powder which has been crushed mechanically or by the hydrogenation crushing method is introduced into an appropriate dry mixing machine such as a rocking mixer, V-type rotating mixer (twin-cylinder mixer), or planetary mixer, and the lubricant is added and mixed with the powder in the machine. The resulting mixture is then finely ground to give a powder mixture for use in compaction.

(2) Mixing during fine grinding:

To the alloy powder which is being finely ground by a dry process in a grinding mill such as a jet mill, vibration mill, or ball mill, the lubricant is added and fine grinding is continued. The lubricant can be added to the alloy powder during fine grinding by injecting it along with an inert carrier gas such as nitrogen gas through an injector comprising a gas inlet having a nozzle attached to the distal end thereof. The resulting finely ground powder mixture may be further subjected to dry mixing in an appropriate mixing machine, if necessary.

(3) Mixing after fine grinding:

To the finely ground alloy powder which is placed in the powder recovering vessel in the grinding mill used for fine grinding or which is transferred to an appropriate dry mixing machine as described above, the lubricant is added and mixed with the powder by a dry process to give a powder mixture for use in compaction.

Also in mixing by method (1) or (3) above, an injector as described with respect to method (2) may be used.

The mixing before fine grinding (1) is advantageous in that the alloy powder is less susceptible to oxidation and in that the lubricant can be added easily since the alloy powder when subjected to mixing is in the form of relatively coarse particles with an average diameter of 20–500 μm. Furthermore, during subsequent fine grinding, the lubricant is further mixed with the alloy powder such that individual particles of the alloy powder are uniformly coated with the lubricant. Therefore, the resulting powder mixture has a high uniformity. However, a substantial part of the lubricant is lost by vaporization during dry mixing and particularly subsequent fine grinding. The degree of loss of the lubricant by vaporization depends on the conditions for fine grinding and the boiling point of the borate ester lubricant, but it is roughly estimated at a half. Therefore, the amount of the lubricant which is added to the alloy powder before fine grinding should be increased so as to compensate for the loss by vaporization. For example, it may be added in an amount of 1.5 to 2 times the amount that is desired to be present in the powder mixture for use in compaction.

In contrast, the loss of the lubricant by vaporization is much smaller or not appreciable when the lubricant is mixed with the alloy powder after fine grinding by method (3). Therefore, it is generally not necessary to add an extra amount of the lubricant, and this is advantageous from the viewpoint of economy. Even when the lubricant is added to the alloy powder after fine grinding, a substantially uniform mixture can be obtained by performing mixing thoroughly. In this respect, the present inventors confirmed the formation of a substantially uniform mixture in this case, which was evidenced by a narrow fluctuation in carbon content when the carbon content of the powder mixture was determined at different points of the mixture.

The mixing during fine grinding (2) is between methods (1) and (3). Therefore, the lubricant may be partially lost during fine grinding and it may be added in an increased amount so as to compensate for the loss.

The proportion of the borate ester lubricant in the powder mixture for use in compaction is selected so as to achieve the desired lubricating effect. The proportion varies with the particle size of the finely ground alloy powder, shapes and dimensions of the die and green compacts and friction area therebetween, and conditions for compression molding or pressing. Unlike a conventional lubricant, the borate ester compound is effective with a very low proportion on the order of 0.01% by weight.

The demolding pressure decreases and moldability is improved with an increasing proportion of the lubricant. However, the incorporation of an excessive amount of the lubricant leads to a decreased strength of the green compacts obtained by pressing and may causes a decrease in yield due to cracking or chipping during subsequent handling of the green compacts. Furthermore, the lubricant may not be completely removed during sintering such that an appreciable proportion of carbon remains in the resulting sintered magnets, thereby adversely affecting the magnet properties. This phenomenon becomes appreciable when the proportion of the lubricant is over 2% by weight.

Accordingly, the borate ester lubricant is preferably present in the powder mixture in a proportion of from 0.01% to 2% and more preferably from 0.1% to 1% by weight based on the weight of the alloy powder. However, when a loss of the lubricant by vaporization is expected, the amount of the lubricant which is added to the alloy powder should be increased so as to compensate for the loss. For example, when the lubricant is added to the alloy powder before fine grinding, the amount of the lubricant to be added may be nearly doubled.

When the borate ester compound used as a lubricant is a liquid having a relatively low viscosity or a solid at the mixing temperature and is thus difficult to uniformly mix with the alloy powder, the lubricant may be diluted with an appropriate solvent before use. Any diluent solvent can be used, but a preferable solvent is a paraffinic hydrocarbon. The use of the lubricant in a diluted form facilitates uniform mixing of the lubricant with the powder mixture. The degree of dilution is not critical as long as uniform mixing can be attained. However, the lubricant is preferably present in a concentration of at least 10% by weight since a higher degree of dilution necessitates an excessively large volume of the solvent and is disadvantageous from the economical view point of economy.

In the case of addition of the borate ester lubricant in a diluted form, it is preferable that the amount of the diluted solution of the lubricant be at least 0.05% by weight based on the weight of the alloy powder in order to assure uniform mixing. Addition of the diluted lubricant in an excessively large amount tends to cause macroscopically detectable agglomeration of the alloy powder, which prevents uniform mixing and results in the production of permanent magnets having deteriorated magnet properties due to carbon segregation. This phenomenon becomes appreciable when the amount of the diluted solution added is over 4% by weight in the case of addition before fine grinding by method (1) or is over 3% by weight in the case of addition after fine grinding by method (3). Therefore, it is preferable that the amount of the diluted solution of the lubricant be not in excess of 3% or 4% by weight depending on the mixing method.

The powder mixture in which the borate ester lubricant is mixed substantially uniformly with the R-Fe-B alloy powder is used in the production of sintered permanent magnets by compression molding, sintering and aging in a conventional manner.

The compression molding or pressing to form green compacts can be performed in the same manner as in conventional powder metallurgy. Compression molding under a magnetic field results in the production of magnetically anisotropic permanent magnets, while compression molding without a magnetic field results in the production of magnetically isotropic permanent magnets. Usually and preferably, compression molding is performed in a magnetic field in order to produce permanent magnets having improved magnet properties. The strength of the magnetic field applied during compression molding is generally at least 8 kOe and preferably at least 10 kOe, while the molding pressure applied is preferably from 0.3 to 3 ton/cm$^2$.

In accordance with the present invention, the powder mixture has improved slip properties due to incorporation of the borate ester compound capable of exhibiting high lubricating properties when added in a small proportion, and the R-Fe-B alloy powder can be readily rotated under application of a magnetic field so as to align the readily magnetizable axes of the individual particles of the alloy powder along the direction of the applied magnetic field, thereby leading to a significant increase in the degree of alignment of the resulting magnets. Moreover, since the lubricant has a high volatility and is added in a small proportion, the resulting sintered magnets have a decreased residual carbon content and good magnet properties.

Furthermore, the borate ester lubricant can provide by itself a satisfactory improvement in moldability (decreased friction and improved mold releasability) and effectively prevent the occurrence of flaws, delaminations, or cracks on the die or green compacts during compression molding without application of a mold release agent. Therefore, the procedure for continuous compression molding is simplified, resulting in an approximately 20% improvement in production efficiency and a prolonged life of the mold. As a result, compression molding can be smoothly performed in a continuous manner in mass production of sintered magnets.

The green powder compacts obtained by compression molding are then sintered, normally at a temperature of approximately 1000°–1100° C. for approximately 1 to 8 hours in a vacuum or in an inert atmosphere such as argon gas to give sintered magnets. The sintered magnets are preferably subjected to aging in order to improve the coercive force. Such aging is usually performed by heating at a temperature of approximately 500°–600° C. for approximately 1 to 6 hours in a vacuum or in an inert atmosphere. The resulting sintered permanent magnets may be coated with an anticorrosive film such as an Ni-plated film in order to protect them from corrosion, if necessary.

Magnetically anisotropic R-Fe-B sintered permanent magnets produced in accordance with the process of the present invention have an intrinsic coercive force (iHc) of at least 1 kOe and a residual flux density (Br) of greater than 4 kG. Their maximum energy product [(BH)max] is equal to or higher than that of hard ferrite magnets. Higher magnet properties can be obtained when the alloy powder has a preferable alloy composition comprising 12–20 at% of R, 4–24 at% of B, and 65–82 at% of Fe in which at least 50 at% of R is constituted by one or more light rare earth elements. Particularly, when the light rare earth element or elements which constitute R Predominantly comprises neodymium (Nd), the magnetically anisotropic sintered permanent magnets can exhibit (iHc)≧ 10 kOe, (Br)≧10 kG, and [(BH-)max]≧35 MGOe.

When the alloy powder used for compaction is prepared by the rapid solidification method, the magnetically anisotropic sintered permanent magnets have further improved magnet properties, particularly with respect to intrinsic coercive force (iHc) and maximum energy product [(BH-)max].

In the cases where up to 50 at% of Fe is replaced by Co, the resulting magnetically anisotropic sintered magnets have magnet properties comparable to the above-described properties with improvement in the temperature dependence of the magnet properties as evidenced by a temperature coefficient of residual flux density which is decreased to 0.1%/°C. or less.

The following examples are presented to further illustrate the present invention. These examples are to be considered in all respects as illustrative and not restrictive. In the examples, all percents are by weight unless otherwise indicated.

The starting materials used to prepare R-Fe-B alloy powders in the examples were 99.9% pure electrolytic iron, ferroboron alloy containing 19.4% B, and a balance of Fe and incidental impurities including C, at least 99.7% pure Nd, at least 99.7% pure Dy, and at least 99.9% pure Co.

EXAMPLE 1

Starting materials were mixed in such proportions as to form an alloy composition of 15% Nd-8% B-77% Fe in atomic percent, and the mixture was melted in an argon atmosphere in a high-frequency induction furnace and then cast into a water-cooled copper mold to give an alloy ingot. The ingot was crushed in a stamp mill to 35 mesh or smaller and then finely ground in a wet ball mill to give an Nd-Fe-B alloy powder having an average particle diameter of 3.3 μm.

As a lubricant, a borate ester compound which was prepared by heating n-butanol and boric acid at a molar ratio of 3:1 for 4 hours at 110° C. to effect a condensation (esterification) reaction and which had the following formula (a) was used.

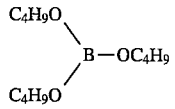

(a)

The alloy powder prepared above was placed into a planetary mixer, and the borate ester compound (a) was added thereto in a proportion of 0.1% based on the weight of the alloy powder and dry-mixed at room temperature to give a powder mixture for use in compaction in which the borate lubricant is substantially uniformly mixed with the alloy powder.

The powder mixture was used to perform compression molding continuously for 50 strokes at a molding pressure of 1.5 ton/cm$^2$ to form disc-shaped green compacts measuring 29 mm in diameter and 10 mm in thickness without application of a mold release agent to the mold while a vertical magnetic field of 10 kOe was applied. The fifty green compacts were heated in an argon atmosphere for 4 hours at 1070° C. for sintering and then for 2 hours at 550° C. for aging to produce Nd-Fe-B sintered permanent magnets exhibiting magnetic anisotropy.

The continuous compression moldability (evaluated by occurrence of flaws, cracks, or delaminations on the green compacts, and generation of an unusual sound during molding), density of the green compacts, and residual carbon content and magnet properties {residual flux density (Br), intrinsic coercive force (iHc), and maximum energy product [(BH)max]} of the sintered magnets are shown in Table 1.

EXAMPLES 2–6

Borate ester compounds which typically had the following formulas (b) to (f), respectively, were used to prepare powder mixtures and perform compression molding, sintering, and aging in the same manner as described in Example 1. The test results are also shown in Table 1.

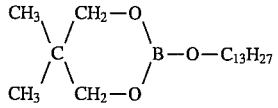

(b)

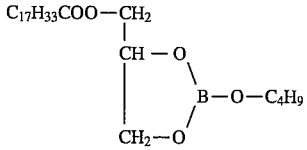

(c)

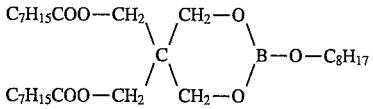

(d)

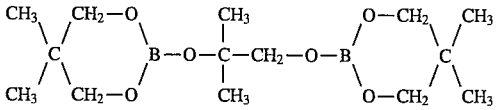

(e)

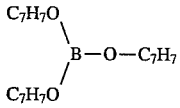

(f)

The borate ester compound used in these examples were prepared by reacting the following alcohols with one mole of boric acid for condensation:

(b) 1 mole of neopentyl glycol and 1 mole of tridecanol;

(c) 1 mole of oleic acid monoglyceride and 1 mole of n-butanol;

(d) 1 mole of pentaerythritol dioctate ester and 1 mole of 2-ethylhexanol;

(e) 1.5 moles of neopentyl glycol (or 3 moles of neopentyl glycol with two moles of boric acid); and (f) 3 moles of benzyl alcohol.

EXAMPLE 7

Following the procedure described in Example 1 except that the borate ester lubricant was mixed with the alloy powder in a wet process, magnetically anisotropic sintered permanent magnets were produced. The wet mixing was performed by mixing the alloy powder with borate ester compound (a) in a proportion of 0.1% based on the weight of the alloy powder in a toluene medium. After mixing, toluene was evaporated to obtain a dry powder mixture. The test results are shown in Table 1.

COMPARATIVE EXAMPLES 1, 2

The alloy powder used in Example 1 was compacted by continuous compression molding in the same manner as described in Example 1 without mixing with a lubricant while the mold used was lubricated with a mold release agent (oligostearyl acrylate) for mold lubrication in Comparative Example 1 or it was not lubricated in Comparative Example 2. The results are shown in Table 1.

COMPARATIVE EXAMPLE 3

Following the procedure described in Example 1 except that lauric acid, which is a typical conventional lubricant of the fatty acid type, was used as a lubricant in a proportion of 0.1% based of the weight of the alloy powder, magnetically anisotropic sintered permanent magnets were produced. The test results are shown in Table 1.

TABLE 1

| No.[1)] | Borate Ester Lubricant Formula | wt % added | wt % in mixture | Continuous Moldability | Compact Density (g/cm³) | Residual Carbon (ppm) | Magnet Properties Br (kG) | iHc (kOe) | (BH)max (MGOe) |
|---|---|---|---|---|---|---|---|---|---|
| EX 1 | (a) | 0.1 | 0.09 | Good | 4.49 | 653 | 12.63 | 12.48 | 38.3 |
| EX 2 | (b) | 0.1 | 0.09 | Good | 4.40 | 660 | 12.61 | 12.44 | 38.1 |
| EX 3 | (c) | 1.0 | 0.98 | Good | 4.61 | 680 | 12.68 | 12.34 | 38.0 |
| EX 4 | (d) | 2.0 | 1.97 | Good | 4.65 | 685 | 12.71 | 12.30 | 37.9 |
| EX 5 | (e) | 0.0 | 0.01 | Good | 4.38 | 670 | 12.60 | 12.50 | 38.4 |
| EX 6 | (f) | 0.1 | 0.09 | Good | 4.45 | 671 | 12.62 | 12.16 | 38.3 |
| EX 7 | (a) | 0.1[2)] | 0.09 | Good | 4.50 | 650 | 12.61 | 12.50 | 38.2 |
| CE 1 | Mold Lubrication | | | Good | 4.29 | 653 | 12.54 | 12.40 | 37.6 |
| CE 2 | None | — | — | Poor | Failure in compression molding | | | | |
| CE 3 | Lauric acid | 0.1 | 0.09 | Poor | Failure in continuous compression molding | | | | |

[1)]EX = EXAMPLE; CE COMPARATIVE EXAMPLE
[2)]Wet-mixing

As can be seen from Table 1, application of a mold release agent (mold lubrication) as employed in Comparative Example 1 provided good continuous moldability, but the resulting green compacts had a density which was lower than that obtained in the Examples. Moreover, due to the friction between particles of the alloy powder which produced a decreased degree of alignment, the magnet properties, particularly the residual flux density (Br), were deteriorated compared to the Examples.

As illustrated in Comparative Example 2, when the compression molding was performed in the absence of a lubricant and without mold lubrication, seizing and galling occurred at the second stroke, resulting in the formation of flaws on the die surface, making further molding operation impossible.

In Comparative Example 3 in which a conventional lubricant was used in continuous compression molding, compression molding could be performed for the first three strokes. However, in further molding, seizing was observed and continuous compression molding could not be performed unless mold lubrication was employed.

In contrast, in the Examples in which a borate ester compound was mixed as a lubricant with an R-Fe-B alloy powder in accordance with the present invention, the lubricant provided the alloy powder with excellent moldability capable of performing continuous compression molding without mold lubrication, in spite of addition of the lubricant in a very small proportion. Few flaws, cracks, or chipping were observed on the green compacts. Elimination of mold lubricant could greatly reduce the operating time required for the continuous compression molding.

Compared to the mold lubrication method employed in Comparative Example 1, the green compacts formed in the Examples had an increased density due to the lubricating effects of the borate ester compounds which served to improve transmission of the applied pressure. The sintered bodies had a residual carbon content at the same level as found in the case of using a conventional lubricant, indicating that the borate ester compounds had high volatility and could be vaporized almost completely during sintering.

The resulting magnetically anisotropic sintered permanent magnets had excellent magnet properties, i.e., they were improved in residual flux density (Br) and maximum energy product [(BH)max] without an appreciable decrease in intrinsic coercive force (iHc). It is thought that such improvement was attributable to the lubricating effects of the borate ester compounds which provided the alloy powder with improved mobility and increased degree of alignment by application of a magnetic field.

EXAMPLE 8

Starting materials were mixed in such proportions as to form an alloy composition of 15% Nd-8% B-77% Fe in atomic percent, and the mixture was melted in an argon atmosphere in a high-frequency induction furnace and then cast into a water-cooled copper mold to give an alloy ingot. The ingot was crushed in a jaw crusher to 35 mesh or smaller and then finely ground in a jet mill to give an Nd-Fe-B alloy powder having an average particle diameter of 3.5 μm.

As a lubricant, the borate ester compound (a) used in Example 1 was added to the finely ground alloy powder contained in the powder recovery vessel of the jet mill in a proportion of 0.1% based on the weight of the alloy powder. The powder was then transferred to the vessel of a rocking mixer and dry-mixed therein for 30 minutes. The resulting powder mixture was recovered from the vessel of the mixer and sampled at three different points (a),(b), and (c). The carbon content of each of the three samples was determined in order to evaluate the uniformity in distribution of the borate ester compound in the mixture. The results are shown in Table 2.

The powder mixture was used to perform compression molding continuously for 50 strokes in the same manner as described in Example 1 without application of a mold release agent to the mold to form fifty disc-shaped green compacts. The green compacts were heated for sintering and aging in the same manner as described in Example 1 to produce Nd-Fe-B sintered permanent magnets exhibiting magnetic anisotropy. The continuous compression moldability, and residual carbon content and magnet properties of the sintered magnets are shown in Table 2.

EXAMPLES 9–13

Following the procedure described in Example 8, an R-Fe-B alloy powder was prepared and mixed with a borate ester compound as a lubricant, and the resulting powder mixture was compacted, sintered, and aged to produce magnetically anisotropic sintered permanent magnets. In these examples, however, the borate ester lubricant used and the method for mixing it with the alloy powder were changed as described below. The results of determination of carbon contents at different points of the powder mixture, continuous compression moldability, and residual carbon content and magnet properties of the sintered magnets are shown in Table 2.

EXAMPLE 9

Borate ester compound (b) was diluted with a paraffinic hydrocarbon to a 20% concentration and the diluted solution was added to the finely ground alloy powder in the vessel of a rocking mixer in a proportion of 0.05% (0.01% as lubricant) based on the alloy powder and dry-mixed therein for 60 minutes.

EXAMPLE 10

Borate ester compound (f) was diluted with a paraffinic hydrocarbon to a 50% concentration, and the diluted solution was added to the finely ground alloy powder in the vessel of a rocking mixer in a proportion of 1.0% (0.5% as lubricant) based on the alloy powder and dry-mixed therein for 20 minutes.

EXAMPLE 11

Borate ester compound (c) was diluted with a paraffinic hydrocarbon to a 60% concentration and the diluted solution was added to the alloy powder in a jet mill in a proportion of 3.0% (1.8% as lubricant) based on the alloy powder while the powder was being finely ground. The addition of the borate ester lubricant was carried out by injection along with an $N_2$ carrier gas through an injector having a nozzle at the distal end thereof. The injection was performed 10 times at regular intervals. The resulting finely ground alloy powder was transferred to the vessel of a rocking mixer and dry-mixed therein for 60 minutes.

EXAMPLE 12

Borate ester compound (e) was diluted with a paraffinic hydrocarbon to a 10% concentration and the diluted solution was added to the finely ground alloy powder in the vessel of a planetary mixer in a proportion of 0.2% (0.02% as lubricant) based on the alloy powder and dry-mixed therein for 20 minutes.

EXAMPLE 13

Borate ester compound (d) was diluted with a paraffinic hydrocarbon to a 50% concentration and the diluted solution was added to the finely ground alloy powder in the vessel of a planetary mixer in a proportion of 2.0% (1.0% as lubricant) based on the alloy powder and dry-mixed therein for 60 minutes.

COMPARATIVE EXAMPLE 4

Following the procedure described in Example 8 except that lauric acid was added as a conventional lubricant to the finely ground alloy powder in the vessel of a rocking mixer in a proportion of 1.0% based of the weight of the alloy powder and dry-mixed therein for 60 minutes, magnetically anisotropic sintered permanent magnets were produced. The results of determination of carbon contents at different points of the powder mixture, continuous compression moldability, and residual carbon content and magnet properties of the sintered magnets are shown in Table 2.

TABLE 2

| | Borate Ester Lubricant | | | Continuous | Carbon (ppm) in mixture at point | | | Residual | Magnet Properties | | |
|---|---|---|---|---|---|---|---|---|---|---|---|
| No.[1)] | Formula | wt % added | wt % in mixture | Moldability | (a) | (b) | (c) | Carbon (ppm) | Br (kG) | iHc (kOe) | (BH)max (MGOe) |
| EX 8 | (a) | 0.1 | 0.08 | Good | 700 | 720 | 730 | 640 | 12.5 | 12.2 | 38.1 |
| EX 9 | (b) | 0.01 | 0.01 | Good | 650 | 660 | 660 | 600 | 12.5 | 12.3 | 38.2 |
| EX 10 | (f) | 0.5 | 0.48 | Good | 790 | 810 | 820 | 690 | 12.7 | 12.1 | 38.9 |
| EX 11 | (c) | 1.8 | 1.75 | Good | 910 | 930 | 930 | 720 | 12.8 | 12.2 | 38.1 |
| EX 12 | (e) | 0.02 | 0.02 | Good | 680 | 680 | 690 | 650 | 12.6 | 12.3 | 38.4 |
| EX 13 | (d) | 1.0 | 0.98 | Good | 890 | 900 | 900 | 720 | 12.6 | 12.2 | 38.3 |
| CE 4 | Lauric acid | 1.0 | 0.09 | Poor | 2400 | 2450 | 2530 | 1650 | 11.0 | 10.2 | 30.5 |

[1)]EX = EXAMPLE; CE = COMPARATIVE EXAMPLE

As can be seen from Table 2, even when the borate ester lubricants were mixed with the alloy powder during or after fine grinding, the lubricant could be distributed substantially uniformly in the alloy powder and the sintered permanent magnets produced had good intrinsic coercive force (iHc), residual flux density (Br), and maximum energy product [(BH)max].

EXAMPLE 14

Starting materials were mixed in such proportions as to form an alloy composition of 15% Nd-8% B-77% Fe in atomic percent, and the mixture was melted in an argon atmosphere in a high-frequency induction furnace and then cast into a water-cooled copper mold to give an alloy ingot. The ingot was crushed in a jaw crusher to 35 mesh or smaller, and the crushed alloy powder was transferred to the vessel of a rocking mixer, to which a lubricant was added.

The lubricant used in this example was the borate ester compound (a) used in Example 1 and it was added to the crushed alloy powder in a proportion of 0.1% based on the weight of the alloy powder and dry-mixed in the rocking mixer for 30 minutes. The resulting powder mixture was then finely ground in a jet mill to give an Nd-Fe-B alloy powder having an average particle diameter of 3.5 μm and containing the borate ester lubricant mixed therewith. The finely ground powder mixture was recovered from the vessel of the jet mill and sampled at three different points (a),(b), and (c). The carbon content of each of the three samples was determined in order to evaluate the uniformity in distribution of the borate ester compound in the mixture. The results are shown in Table 3.

The powder mixture was used to perform compression molding continuously for 50 strokes in the same manner as described in Example 1 without application of a mold release agent to the mold to form fifty disc-shaped green compacts. The green compacts were heated for sintering and aging in the same manner as described in Example 1 to produce Nd-Fe-B sintered permanent magnets exhibiting magnetic anisotropy. The continuous compression moldability, and residual carbon content and magnet properties of the sintered magnets are shown in Table 3.

EXAMPLES 15–19

Following the procedure described in Example 14, an R-Fe-B alloy powder was prepared and mixed with a borate ester compound as a lubricant before fine grinding, and the resulting powder mixture was compacted, sintered, and aged to produce magnetically anisotropic sintered permanent magnets. In these examples, however, the borate ester lubricant used and the method for mixing it with the alloy powder were changed as described below. The results of determination of carbon contents at different points of the powder mixture, continuous compression moldability, and residual carbon content and magnet properties of the sintered magnets are shown in Table 3.

EXAMPLE 15

Borate ester compound (b) was diluted with a paraffinic hydrocarbon to a 20% concentration and the diluted solution was added to the crushed alloy powder in the vessel of a rocking mixer in a proportion of 0.10% (0.02% as lubricant) based on the alloy powder and dry-mixed therein for 60 minutes. The powder mixture was then finely ground to an average particle diameter of 3.5 μm.

EXAMPLE 16

Borate ester compound (f) was diluted with a paraffinic hydrocarbon to a 50% concentration and the diluted solution was added to the crushed alloy powder in the vessel of a rocking mixer in a proportion of 2.0% (1.0% as lubricant) based on the alloy powder and dry-mixed therein for 30 minutes. The powder mixture was then finely ground to an average particle diameter of 4.0 μm.

EXAMPLE 17

Borate ester compound (c) was diluted with a paraffinic hydrocarbon to a 70% concentration and the diluted solution was added to the crushed alloy powder in the vessel of a rocking mixer in a proportion of 4.0% (2.8% as lubricant) based on the alloy powder and dry-mixed therein for 60 minutes. The powder mixture was then finely ground to an average particle diameter of 4.0 μm.

EXAMPLE 18

Borate ester compound (e) was diluted with a paraffinic hydrocarbon to a 10% concentration and the diluted solution was added to the crushed alloy powder in the vessel of a V-type rotating mixer in a proportion of 0.5% (0.05% as lubricant) based on the alloy powder and dry-mixed therein for 20 minutes. The powder mixture was then finely ground to an average particle diameter of 4.0 μm.

EXAMPLE 19

Borate ester compound (d) was diluted with a paraffinic hydrocarbon to a 50% concentration and the diluted solution was added to the crushed alloy powder in the vessel of a V-type rotating mixer in a proportion of 4.0% (2.0% as lubricant) based on the alloy powder and dry-mixed therein for 60 minutes. The powder mixture was then finely ground to an average particle diameter of 4.0 μm.

COMPARATIVE EXAMPLE 5

Following the procedure described in Example 14 except that lauric acid was added as a conventional lubricant to the crushed alloy powder in the vessel of a rocking mixer in a proportion of 2.0% based of the weight of the alloy powder and dry-mixed therein for 60 minutes, magnetically anisotropic sintered permanent magnets were produced. The results of determination of carbon contents at different points of the powder mixture, continuous compression moldability, and residual carbon content and magnet properties of the sintered magnets are shown in Table 3.

TABLE 3

| | Borate Ester Lubricant | | | Continuous | Carbon (ppm) in mixture at point | | | Residual | Magnet Properties | | |
|---|---|---|---|---|---|---|---|---|---|---|---|
| No.[1)] | Formula | wt % added | wt % in mixture | Moldability | (a) | (b) | (c) | Carbon (ppm) | Br (kG) | iHc (kOe) | (BH)max (MGOe) |
| EX 14 | (a) | 0.1 | 0.06 | Good | 680 | 700 | 710 | 650 | 12.4 | 12.0 | 37.8 |
| EX 15 | (b) | 0.021 | 0.01 | Good | 660 | 660 | 680 | 610 | 12.3 | 12.4 | 38.1 |
| EX 16 | (f) | 1.0 | 0.55 | Good | 770 | 800 | 800 | 680 | 12.5 | 12.0 | 37.7 |
| EX 17 | (c) | 2.8 | 1.75 | Good | 880 | 900 | 910 | 700 | 12.2 | 12.8 | 37.8 |
| EX 18 | (e) | 0.052 | 0.03 | Good | 660 | 680 | 690 | 630 | 12.2 | 12.2 | 38.1 |
| EX 19 | (d) | 2.0 | 1.30 | Good | 920 | 930 | 950 | 760 | 12.4 | 12.0 | 38.0 |
| CE 5 | Lauric acid | 2.0 | 1.25 | Poor | 2050 | 2250 | 2340 | 1570 | 11.3 | 11.2 | 31.1 |

[1)]EX = EXAMPLE; CE = COMPARATIVE EXAMPLE

As can be seen from Table 3, also in the cases where the borate ester lubricants were mixed with the alloy powder before fine grinding, the lubricant could be distributed substantially uniformly in the alloy powder and the sintered permanent magnets produced had good intrinsic coercive force (iHc), residual flux density (Br), and maximum energy product [(BH)max].

EXAMPLE 20

A molten alloy having a composition of 14.0% Nd-0.6% Dy-6.1% B-2.8% Co-76.5% Fe in atomic percent was used to prepare R-Fe-B alloys A to C in the following manner.

A. The molten alloy was rapidly solidified in an argon atmosphere by the single roll method to give a flaky alloy having a thickness of 0.3 mm and a maximum width of 200 mm. The cooling conditions were a roll diameter of 300 mm and a circumferential speed of 2 m/s.

B. The molten alloy was rapidly solidified in an argon atmosphere by the twin roll method to give a flaky alloy having a thickness of 0.5 mm and a maximum width of 150 mm. The cooling conditions were a roll diameter of 300 mm and a circumferential speed of 2 m/s.

C. The molten alloy was cast into a water-cooled mold having a cavity width of 50 mm to give an ingot alloy.

Each of the flaky alloys A and B had an average grain size in the range of 3–10 μm when 100 columnar grains were observed to determine their width at three different points along the longitudinal axis of the alloy flake. The average grain size of ingot alloy C was over 50 μm.

These alloys were crushed by a conventional hydrogenation crushing method and then finely ground in a jet mill to give an alloy powder having an average diameter in the range of 3–4 μm for each of Alloys A to C. Each of these alloy powders was used in compaction (compression molding) in two forms, one after being mixed with a lubricant (for internal lubrication), the other without internal lubrication.

The lubricant used in this example for internal lubrication was the borate ester compound (a) used in Example 1. It was added to each of the finely ground alloy powders in a proportion of 0.1% based on the weight of the alloy powder and dry-mixed in a planetary mixer at room temperature for 30 minutes.

These two forms of alloy powders were used to perform compression molding continuously for 50 strokes at a molding pressure of 1.5 ton/cm$^2$ to form disc-shaped green compacts measuring 29 mm in diameter and 10 mm thick while a vertical magnetic field of 10 kOe was applied. In the compression molding, mold lubrication was not performed when the alloy powder contained the lubricant for internal lubrication. On the other hand, when the alloy powder did not contain the lubricant, mold lubrication was performed by applying a fatty acid ester as a mold releasing agent to the mold. The green compacts were heated in an argon atmosphere for 4 hours at 1070° C. for sintering and then, after cooling, for 1 hours at 500° C. for aging to produce R-Fe-B sintered permanent magnets exhibiting magnetic anisotropy.

The continuous compression moldability (evaluated by occurrence of flaws, cracks, or delaminations in the green compacts, and generation of an unusual sound during molding), green density of the green compacts, and residual carbon content and magnet properties of the sintered magnets are shown in Table 4.

TABLE 4

| Mother Alloy[1)] | Lubricating Method[2)] | Compact Density (g/cm$^3$) | Magnet Properties Br (kG) | iHc (kOe) | (BH)max (MGOe) | Residual Carbon (ppm) | Continuous Moldability |
|---|---|---|---|---|---|---|---|
| A | Internal | 4.50 | 13.70 | 14.23 | 45.1 | 615 | Good |
| | Mold | 4.30 | 13.42 | 14.04 | 43.3 | 610 | Good |
| B | Internal | 4.50 | 13.80 | 14.25 | 45.8 | 615 | Good |
| | Mold | 4.30 | 13.43 | 14.05 | 43.5 | 610 | Good |
| C | Internal | 4.51 | 12.61 | 11.54 | 38.2 | 615 | Good |
| | Mold | 4.29 | 12.54 | 11.40 | 37.8 | 610 | Good |

[1)]A = Rapidly solidified alloy by the single roll method
B = Rapidly solidified alloy by the twin roll method
C = Cast ingot alloy
[2)]Internal: Mixing of Borate ester (a) with alloy powder
Mold: Mold lubrication with a fatty acid ester When the mother alloy was rapidly solidified alloy A or B, sintered permanent magnets having further improved magnet properties with respect to iHc and (BH)max could be produced when compression molding was performed by internal lubrication with a borate ester compound according to the present invention.

EXAMPLES 21–25

To a finely ground alloy powder obtained from mother alloy A prepared by the single roll method as described in Example 20, borate ester compounds (b) to (f) were separately added in the proportions shown in Table 5 and mixed in the same manner as described in Example 1. Borate esters (b) to (e) were added without dilution, and borate ester (f) was added after dilution with n-dodecane to a 50% concentration.

The resulting powder mixtures were used to produce magnetically anisotropic sintered permanent magnets by performing compression molding, sintering, and aging under the same conditions as described in Example 20 without mold lubrication.

EXAMPLE 26

Borate ester compound (a) was wet-mixed in a toluene medium with a finely ground alloy powder obtained from mother alloy A prepared by the single roll method as described in Example 20 and then dried to remove toluene. The resulting powder mixture was used to produce magnetically anisotropic sintered permanent magnets by performing compression molding, sintering, and aging under the same conditions as described in Example 20 without mold lubrication.

COMPARATIVE EXAMPLE 6, 7

A finely ground alloy powder obtained from mother alloy A prepared by the single roll method as described in Example 20 was compacted by continuous compression molding in the same manner as described in Example 1 after mixing with lauric acid as a conventional lubricant in Comparative Example 6 or without addition of a lubricant and without mold lubrication in Comparative Example 7.

The continuous compression moldability, green density of the green compacts, and residual carbon content and magnet properties of the sintered magnets in Examples 21 to 26 and Comparative Examples 6 and 7 are shown in Table 5 along with the proportions of the lubricants added.

TABLE 5

| | Borate Ester Lubricant | | | Compact | Magnet Properties | | | Residual | Continuous |
|---|---|---|---|---|---|---|---|---|---|
| No.[1)] | Formula | wt % added | wt % in mixture | Density (g/cm³) | Br (kG) | iHc (kOe) | (BH)max (MGOe) | Carbon (ppm) | Moldability |
| EX 21 | (b) | 0.1 | 0.09 | 4.51 | 13.69 | 14.21 | 45.1 | 610 | Good |
| EX 22 | (c) | 0.2 | 0.19 | 4.50 | 13.71 | 14.23 | 45.2 | 615 | Good |
| EX 23 | (d) | 1.0 | 0.98 | 4.60 | 13.72 | 14.10 | 45.2 | 630 | Good |
| EX 24 | (e) | 0.3 | 0.29 | 4.59 | 13.65 | 14.15 | 44.8 | 618 | Good |
| EX 25 | (f) | 0.1[2)] | 0.09 | 4.50 | 13.68 | 14.20 | 45.0 | 614 | Good |
| EX 26 | (a) | 0.1[3)] | 0.09 | 4.49 | 13.69 | 14.25 | 45.1 | 615 | Good |
| CE 6 | Lauric acid | 0.1 | 0.09 | Failure in continuous compression molding | | | | | Poor |
| CE 7 | None | — | — | Failure in compression molding | | | | | Poor |

[1)]EX = EXAMPLE; CE = COMPARATIVE EXAMPLE
[2)]Addition after dilution with n-dodecane (0.2 wt % of diluted solution added)
[3)]Wet mixing As can be seen from Table 5, even though the finely ground alloy powder used for compaction was prepared from the rapidly solidified alloy A, the results in Comparative Examples 6 and 7 were almost the same as in Comparative Examples 2 and 3 in which an ingot alloy was used to prepare the finely ground alloy powder. Namely, compression molding without lubrication caused seizing and galling to occur at the first stroke, making further molding operation impossible. When a conventional lubricant was used, continuous compression molding could be performed for the first several strokes. However, seizing was observed at about the ninth stroke and continuous compression molding could not be performed further.

In contrast, when a borate ester was mixed with the finely ground alloy powder in accordance with the present invention, continuous compression molding could be performed successfully to produce sintered magnets having improved magnet properties after sintering and aging regardless of the type of the borate ester.

EXAMPLE 27

The molten alloy prepared in Example 20 was used to prepare 2 mm-, 3 mm-, and 4 mm-thick thin sheet alloys by rapid solidification by the single roll method. Following the procedure described in Example 20. The thin sheets were crushed and finely ground and the finely ground alloy powders were mixed with borate ester compound (a) and used to perform compression molding, sintering, and aging and produce R-Fe-B sintered permanent magnets. The effects of the thickness of the rapidly solidified sheet alloy on the average grain size thereof and on (BH)max of the magnets are shown in Table 6 below.

TABLE 6

| Thickness | 2 mm | 3 mm | 4 mm |
|---|---|---|---|
| Average grain size (μm) | 13 | 18 | 40 |
| (BH)max (MGOe) | 43.0 | 42.5 | 38.5 |

When the results of Table 6 are compared with those of Table 4, the average grain size increased with increasing thickness of the sheet due to a decreased cooling rate. However, when the sheet thickness was up to 3 mm, the average grain size of the alloy was not greater than 30 μm and the resulting magnets had a value for (BH)max at a high level. In contrast, when the sheet thickness was over 3 mm, the average grain size was increased so as to exceed 30 μm and the magnets had a significantly decreased value for (BH)max.

It will be appreciated by those skilled in the art that numerous variations and modifications may be made to the invention as described above with respect to specific embodiments without departing from the spirit or scope of the invention as broadly described.

What is claimed is:

1. A process for producing R-Fe-B sintered permanent magnets, comprising compacting a powder mixture which consists essentially of a fine R-Fe-B alloy powder and at least one boric acid ester compound substantially uniformly mixed with the alloy powder, the R-Fe-B alloy powder being comprised predominantly of 10–30 atomic % of R (wherein R stands for at least one element selected from rare earth elements including yttrium), 2–28% of B, 65–82 atomic % of Fe, and 0 to 41 atomic % of Co, by compression molding to form green compacts, and sintering the resulting green compacts.

2. The process according to claim 1, wherein the compression molding is performed in a magnetic field.

3. The process according to claim 1, wherein the sintering is performed at a temperature between 1000° C. and 1100° C.

4. The process according to claim 1, which further comprises subjecting the sintered compacts to aging.

5. The process according to claim 1, wherein the boric acid ester compound is present in the powder mixture in a proportion of from 0.01% to 2% by weight based on the weight of the alloy powder.

6. The process according to claim 1, wherein the boric acid ester compound is present in the powder mixture in a proportion of from 0.1% to 1% by weight based on the weight of the alloy powder.

7. The process according to claim 1, further comprising preparing the alloy powder by crushing and finely grinding an alloy ingot.

8. The process according to claim 1, further comprising preparing the alloy powder by rapidly solidifying a molten alloy by the single roll or twin roll method to form a thin sheet or thin flakes which have a thickness of 0.05–3 mm and which consist of fine grains in the range of 3–30 μm, and crushing and finely grinding the thin sheet or thin flakes.

9. The process according to claim 8, wherein the crushing is performed by the hydrogenation crushing method.

10. The process according to claim 1, wherein the boric acid ester compound is mixed with the alloy powder before fine grinding thereof.

11. The process according to claim 1, wherein the boric acid ester compound is mixed with the alloy powder during fine grinding thereof.

12. The process according to claim 1, wherein the boric acid ester compound is mixed with the alloy powder after fine grinding thereof.

13. The process according to claim 1, wherein the alloy powder in the powder mixture has a composition of 10–25 atomic % of R, 4–26 atomic % of B, and 65–82 atomic % of Fe.

14. The process according to claim 13, wherein up to 50 atomic % of Fe is replaced by Co.

15. The process according to claim 1, wherein the alloy powder in the powder mixture has a composition of 10–20 atomic % of R, 4–24 atomic % of B, and 65–82 atomic % of Fe.

16. The process according to claim 15, wherein up to 50 atomic % of Fe is replaced by Co.

17. The process according to claim 1, wherein the alloy powder has an average particle diameter of 1–20 μm.

18. The process according to claim 1, wherein R consists essentially of Nd.

19. The process according to claim 1, wherein the powder mixture has a residual carbon content of ≦760 ppm.

20. The process according to claim 1, wherein the powder mixture has a residual flux density (Br) of at least 10 kG.

21. The process according to claim 1, wherein the powder mixture has an intrinsic coercive force (iHc) of at least 10 kOe.

22. The process according to claim 1, wherein the powder mixture has a maximum energy product (BH max) of at least 35 MGOe.

23. The process according to claim 1, wherein the powder mixture has a density of at least 4.3 g/cm$^3$.

24. The process according to claim 2, wherein the at least one boric acid ester is present in amounts sufficient to permit rotation and alignment of magnetizable axes of the alloy powder during the compaction in the applied magnetic field.

25. The process according to claim 1, wherein the powder of the powder mixture has an average particle size of 1–20 μm.

26. The process according to claim 1, wherein the boric acid ester is a boric acid tri-ester compound obtained by esterification of boric acid or boric anhydride with one or more monohydric alcohols having 3 to 18 carbon atoms.

* * * * *